US005301580A

United States Patent [19]

Rosene et al.

[11] Patent Number: 5,301,580

[45] Date of Patent: Apr. 12, 1994

[54] LOCKING RING STRIPPER PLATE ASSEMBLY

[75] Inventors: Ronald G. Rosene, Coon Rapids; Richard L. Timp, Vadnais Heights; John H. Morehead, White Bear Lake, all of Minn.

[73] Assignee: Wilson Tool International, Inc., White Bear Lake, Minn.

[21] Appl. No.: 958,019

[22] Filed: Oct. 7, 1992

[51] Int. Cl.[5] ..... B21D 45/08; B26D 7/18

[52] U.S. Cl. ..... 83/136; 83/140

[58] Field of Search ..... 83/136, 138, 139, 140, 83/141, 142, 143, 684, 685, 686, 698, 699

[56] References Cited

U.S. PATENT DOCUMENTS

| | | | |
|---|---|---|---|
| 3,079,824 | 3/1963 | Schott | 83/140 |
| 3,114,280 | 12/1963 | Schott | 83/140 |
| 3,296,905 | 1/1967 | Killaly | 83/140 |
| 3,540,339 | 11/1970 | Kilally | 83/140 |
| 3,742,804 | 7/1973 | Pattersen et al. | 83/686 X |
| 4,092,888 | 6/1978 | Wilson | 83/140 |
| 4,248,111 | 2/1981 | Wilson et al. | 83/140 |
| 4,377,957 | 3/1983 | Wheeler | 83/103 |
| 4,446,767 | 5/1984 | Wilson | 83/136 |
| 4,947,718 | 8/1990 | Whistler | 83/138 |
| 4,989,484 | 2/1991 | Johnson et al. | 83/140 |
| 5,127,293 | 7/1992 | Chatham | 83/136 |

FOREIGN PATENT DOCUMENTS

| | | | |
|---|---|---|---|
| 2641486 | 7/1990 | France | 83/686 |
| 1075993 | 7/1967 | United Kingdom | 83/143 |
| 1251843 | 11/1971 | United Kingdom | 83/140 |

*Primary Examiner*—Eugenia Jones
*Assistant Examiner*—Raymond D. Woods
*Attorney, Agent, or Firm*—Fredrikson & Byron

[57] ABSTRACT

A punch guide sleeve and stripper plate assembly useable with a punch set of the type having a punch disposed within the punch guide sleeve and adapted to be reciprocally advanced through an opening of the stripper plate attached to one end of the punch guide sleeve by the ram of a punch press. The stripper plate assembly includes a rotatable stripper plate cap which may be manually rotated with respect to the guide sleeve end from a locked to an unlocked position to secure and release the stripper plate through tightening and loosening a retaining wire onto and away from the stripper plate. The retaining wire is preferably substantially circular in cross-section and split to provide two unconnected ends that are attached to the stripper plate cap and the guide sleeve. When these two ends are drawn together in the locked position, the arcuate wire will be diametrally compressed for engagement with the stripper plate. Preferably, a spring loaded button and catch arrangement is provided that releasably locks the stripper cap in the locked position to maintain the retaining wire in contact with an annular edge portion of the stripper plate.

24 Claims, 8 Drawing Sheets

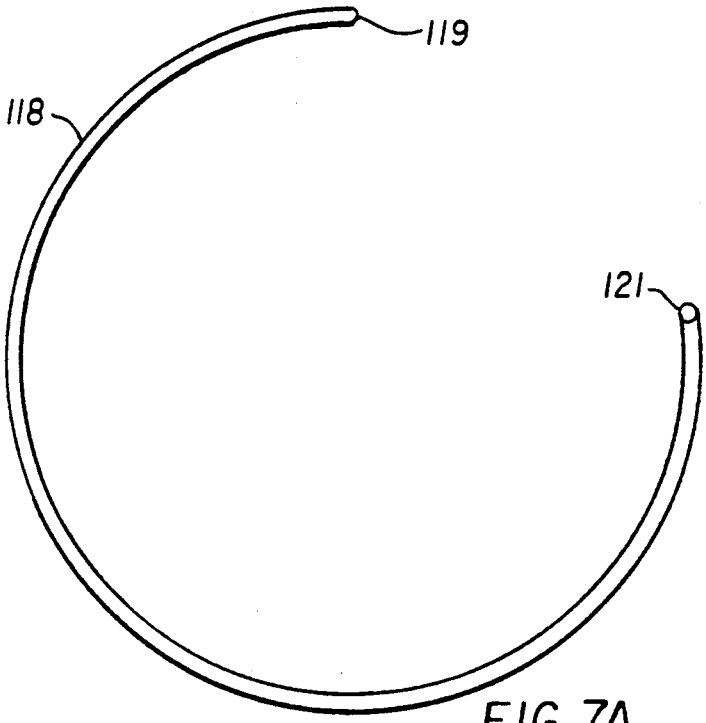
FIG. 7A
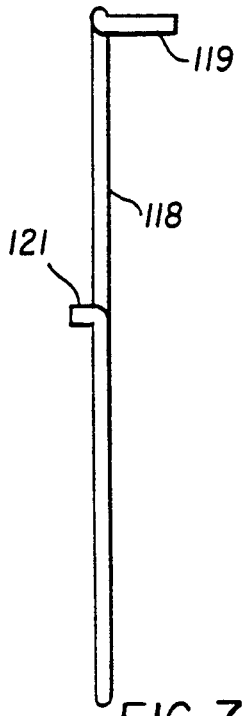
FIG. 7B
FIG. 8A
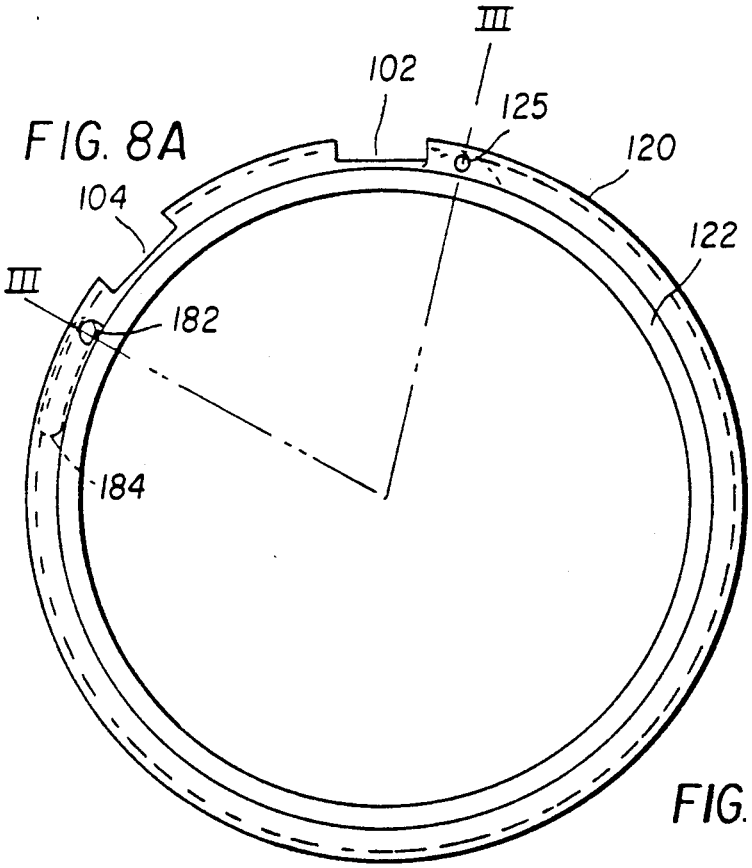
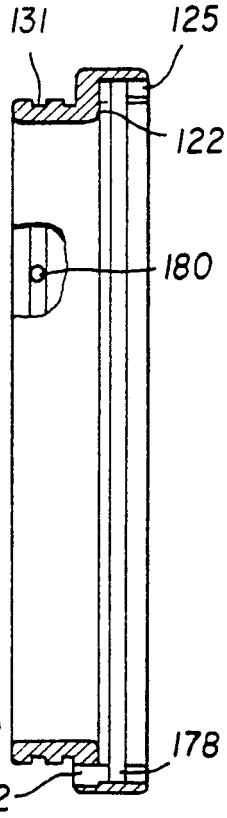
FIG. 8B

LOCKING RING STRIPPER PLATE ASSEMBLY

BACKGROUND OF THE INVENTION

1. Cross Reference to Related Application

Reference is directed to commonly assigned U.S. patent application Ser. No. 07/958021, now pending, filed on even date herewith in the names of Richard L. Timp, Michael W. Schultz, and John H. Morehead, and entitled *ADJUSTABLE LENGTH PUNCH SET ASSEMBLY.*

2. Technical Field

This invention relates generally to punch guide assemblies such as those usable with multiple-station turret punch machines, and more particularly to stripper plate assemblies.

3. Description of the Prior Art

Multiple-station turret punch machines such as Amada Lyla series Model 50-50-72 can provide up to 72 different punch stations for use in conjunction with a like number of opposing dies. In such a machine, each punch station operates as a punch set holder for a removable punch set that includes a centrally disposed punch surrounded by a punch guide and biased by a punch spring. Even with the flexibility afforded by a 72-station machine, the operator may wish to change some or all of the punch set and die combinations from time to time. For instance, the operator may wish to utilize a different punch blade shape or size in a punch set. It is desirable to minimize the time required and make it simple to so change the punch and die components, and thereby reduce down time for the punch machine.

In the punching operation, after the punch blade enters the workpiece surface, the edge of the cut surface will tend to follow the punch blade as it retracts. As a result, "stripping" occurs; that is, the edges around the punched hole will bear outwardly and necessitate further time consuming finishing operations.

To prevent stripping, the punch guide may be provided with a stripper plate. The stripper plate has an opening such that a punch blade will fit snugly therethrough but, yet will be able to axially move freely through the opening. In use, the punch guide is oriented with the stripper plate flush against the workpiece surface. Then, when the punch blade retracts from the workpiece, the edges of the workpiece around the punch hole will be prevented by the stripper plate from following the retracting punch blade.

One such punch guide stripper plate configuration incorporates the stripper plate as an integral part of the punch guide itself. Since the size and shape of the stripper plate hole must coincide closely with the punch blade, however, each such punch guide may only be used with one matching punch. Consequently, interchanging punch and die combinations may be inconvenient, since the operator must change not only the die and punch, but the punch guide as well.

Another configuration uses flattened metal clip or the like to retain a removable stripper plate at the end of a punch guide. This allows the use of a number of different punch blades with each guide, since only the stripper plate need be changed for each new punch blade. These spring clip structures, however, have not provided completely satisfactory performance. Often, the workpiece surface will have a thin coating of oil or other fluid. When the stripper plate meets the workpiece surface, a suction may be created. When this occurs, the stripper plate may be pulled out of place and damage may result to the workpiece and to the stripper plate. Down time may also become a problem. Finally, these clips also tend to weaken with usage, aggravating the above-noted problems.

Another configuration is shown in commonly assigned U.S. Pat. No. 4,092,888 which depicts a punch guide assembly using a resilient, flat retaining ring to hold a removable stripper plate in place.

And in yet another configuration, commonly assigned U.S. Pat. No. 4,248,111 depicts a punch guide assembly that makes use of stripper plate holding tabs that are formed on clips attached parallel to the primary axis of the punch guide.

A further locking ring stripper plate assembly is disclosed in commonly assigned U.S. Pat. No. 4,446,767 wherein a locking ring 13 is fitted in matching circumferential grooves in a stripper plate 12 in the punch guide sleeve 11. The free ends 31 of the locking ring 13 include tabs 32 that may be spread apart and locked into position by the locking ring expansion lock 14. Thus, although installation and removal of the stripper plate is relatively simple, it involves handling the loose ring 13 and the cap screw used as the locking ring expansion lock 14. The manipulation of these small, difficult-to-handle parts, may be time consuming.

Other mechanisms for retaining stripper plates in the ends of punch guides are described in U.K. patent specification 1 251 843 and U.S. Pat. Nos. 3,079,824 to Schott, 3,540,339 to Killaly, 4,947,718 to Whistler, and 4,989,484 to Johnson, et al.

In the U.K. patent specification, an O-ring 25 in annular mating grooves in the punch guide sleeve and the stripper plate provides a snap fit of the stripper plate 21 to the punch guide 18. The '824 patent also illustrates a snap ring 38 for retaining stripper plate 36 in position. Such snap rings may not be strong and reliable enough to lock stripper plates in position.

The '339 patent employs retainers 60 and spring-mounted elements 56 for engagement against v-shaped annular detent grooves 57 in the edge of the stripper plate 62. Attachment and removal involves loosening the retainers 60 and moving them aside to snap in or unsnap the spring-loaded catches 56 in or out of the grooves. The redundant attachment mechanism requires additional steps in releasing or locking the stripper plate.

The '718 patent shows in FIGS. 5, 7 and 14 the use of spring clips 194 attached to the punch guide and engaging internally-threaded annual flanges 196 in the stripper plate 46 in a fashion similar to the '111 patent. Such spring clips may not be strong enough for large diameter punch sets and may weaken with repeated use.

The '484 patent discloses a complex locking ring 80 with positioning springs 90 and 92 located within a groove and positioned between a pair of diametrically opposed pins 94, 96 that engage other pins, such as 98, to hold the ring 80 in the lock position. The stripper plate 74 is held in place in the locking ring by centrally extending flanges 109 and pin receiving slots 110 to cover the pins 74D. To remove or replace the stripper plate 74, the locking ring 80 is turned about the axis of the punch assembly against the compression of the springs 90, 92, thereby aligning the pin receiving slots 110 with the pin 74D and allowing the stripper plate 74 to be removed and re-inserted in the fashion of a bayonet-lock mechanism. Then by pushing the stripper plate in and depressing release pin 112, the springs 90, 92 rotate locking ring 80 on the box 76 so the flanges 109 cover the pins 74D thereby holding the stripper plate 74 securely in place on the end of the punch assembly 10. This rotatable retaining ring and stripper plate assembly constitutes a number of small parts, such as pins and springs, that add to complexity and fabrication costs. Moreover, the stripper plate retaining ring itself is removed when the stripper plate is released which can lead to its loss or damage if dropped.

Despite the effort put into designing various types of attachment mechanisms for stripper plates, a need remains for simple, strong, reliable and inexpensive to manufacture stripper plate locking mechanisms that are easy and quick to use in releasing or attaching the stripper plate, do not include small loose parts and securely hold the stripper plate when locked.

SUMMARY OF THE INVENTION

The invention disclosed herein constitutes and improved stripper plate assembly for allowing stripper plates to be easily and securely affixed to and removed to and from an appropriate punch guide sleeve. This invention finds particular applicability with relatively wide punch guide sleeves. The improvement may be manufactured economically, and does not require any special custom-made tools to operate or involve the separation of attachment components from the guide sleeve.

The stripper plate assembly differs most markedly from existing stripper plate assemblies by the provision of a rotatable stripper plate cap which may be manually rotated with respect to the guide sleeve end from a locked to an unlocked position to secure and release the stripper plate through tightening and loosening a retaining wire onto and away from the stripper plate. The retaining wire is preferably substantially circular or rectangular in cross-section and split to provide two unconnected ends that are attached to the stripper plate cap and the guide sleeve one another. When these two ends are drawn together in the locked position, the arcuate wire will be diametrally compressed for engagement with the stripper plate.

Thus, in accordance with the invention, a punch guide sleeve and stripper plate assembly useable with a punch set of the type having a punch disposed within the punch guide sleeve and adapted to be reciprocally advanced through an opening of the stripper plate attached to one end of the punch guide sleeve by the ram of a punch press, is disclosed wherein the stripper plate further includes an annular edge portion and stripper plate locking means for locking the annular edge portion of the stripper plate to a seat in a locked position and releasing the stripper plate from the stripper plate receiving seat in an unlocked position, the locking means further comprising: a stripper cap having a first annular surface for engaging with the punch guide sleeve for moving between the locked and unlocked position; a retaining wire having first and second ends and formed in an arcuate shape for engaging with the annular edge portion of the stripper plate in the locked position of the stripper cap means and for withdrawing from the annular edge portion of the stripper plate in the unlocked position thereof; and means for attaching the first end of the retaining wire to the stripper cap and the second end of the retaining means to the sleeve means, whereby movement of the cap draws the first and second ends toward one another in the locked position and away from one another in the unlocked position.

Preferably the locking means further comprises a spring loaded button and catch arrangement that releasably locks the stripper cap in the locked position to maintain the retaining wire in contact with the annular edge portion of the stripper plate.

In a first illustrated preferred embodiment, the seat is formed in the end of the sleeve and the stripper cap is formed with a second inwardly directed annular surface for receiving the retaining wire between the second inwardly directed annular surface and the end of the sleeve in the unlocked position.

In a second illustrated preferred embodiment, the stripper cap is formed with a second annular surface defining the seat, the annular edge portion of the stripper plate comprises a groove extending around the side edge of the stripper plate for receiving the retaining wire in the locked position, and the stripper cap further comprises an annular slot extending around the stripper cap adjacent to the groove in the stripper plate positioned in the seat for receiving the retaining wire in the unlocked position.

Other embodiments substitue more than one retaining wire for the single retaining wires of the first and second illustrated embodiments.

BRIEF DESCRIPTION OF THE DRAWINGS

Other objects, advantages and features of the present invention will become more apparent upon reference to the following detailed description, and particularly when considered in view of the appended drawings wherein:

FIGS. 7A and 7B are plan and side views of a retaining wire employed in the second preferred embodiment of the present invention;

FIGS. 8A–8C are top plan, cross-section side and bottom plan views of the second preferred embodiment of a stripper cap employed in the assembly depicted in FIG. 6.

DETAILED DESCRIPTION OF THE PREFERRED EMBODIMENTS OF THE INVENTION

The locking ring stripper plate assembly of the present invention as illustrated in the figures is preferably implemented in relatively large diameter punch sets of the type disclosed in the '767 patent that have relatively large and heavy stripper plates, although the invention may be practiced in a variety of punch set types. Three preferred embodiments are illustrated in the figures and described, together with variations on the illustrated embodiments, as follows.

Figure 1:
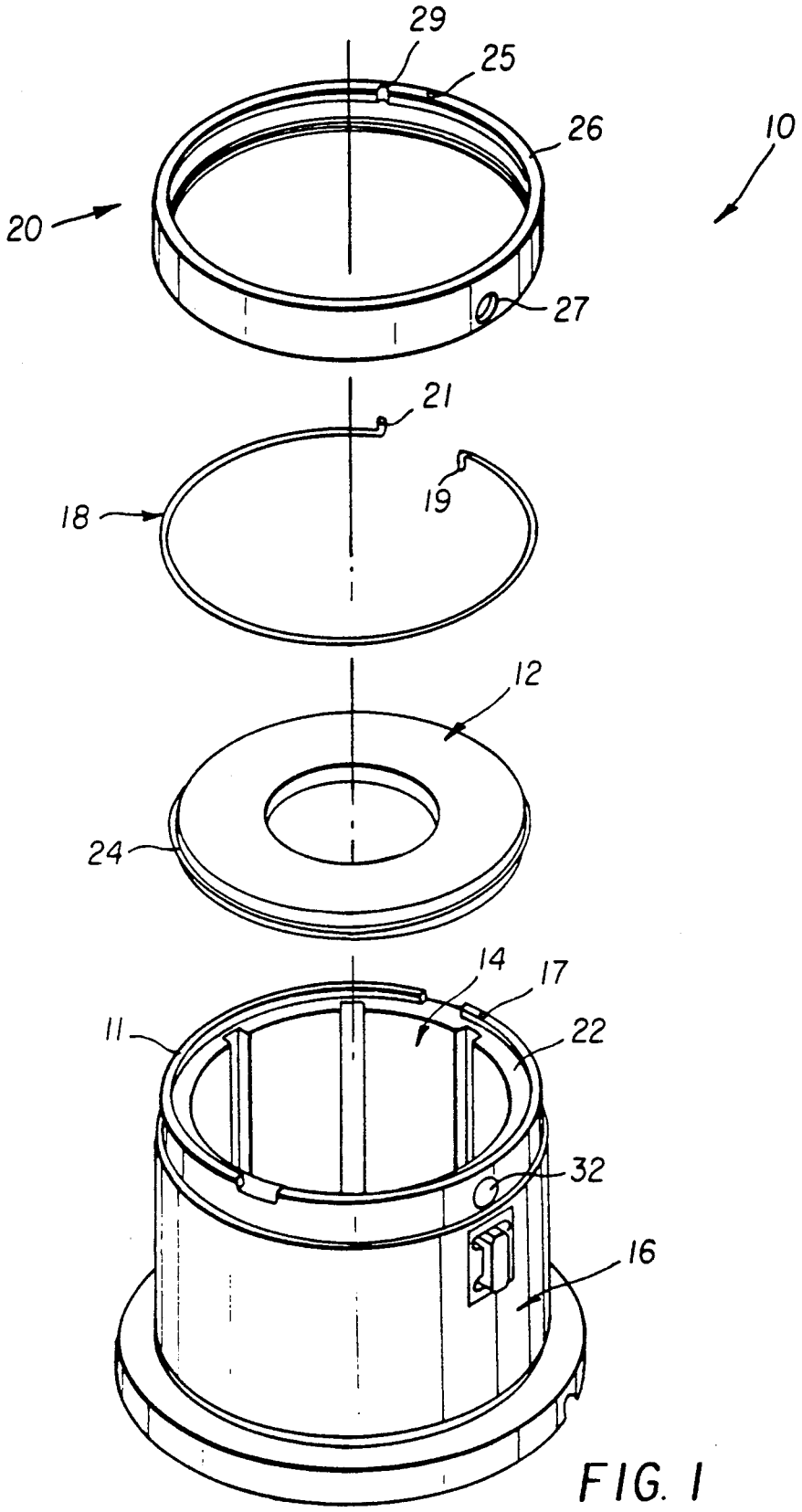
FIG. 1 is an exploded, perspective view of a first preferred embodiment of the locking ring stripper plate assembly of the present invention.
Figure 2:
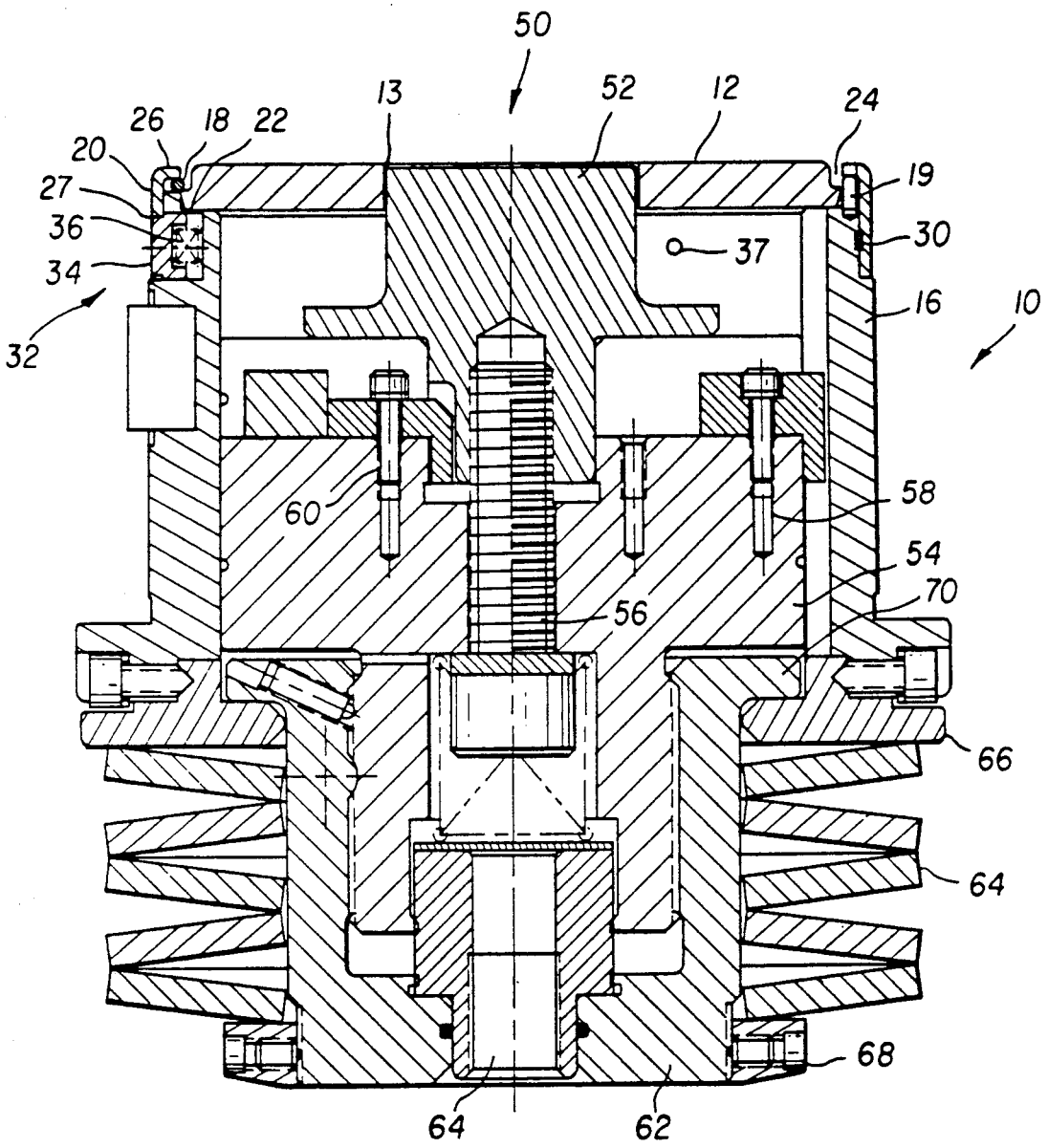
FIG. 2 is a cross-sectional view of a punch set assembly depicting the elements of the locking ring stripper plate assembly in accordance with the first preferred embodiment of the present invention.

Referring now to the drawings, and in particular to FIG. 1, it illustrates in an exploded perspective view most of the components of the first preferred embodiment of the locking ring stripper plate assembly that are employed to hold the stripper plate 12 in the opening 14 of the punch guide sleeve 16 which itself is intended to be assembled into the punch set 10 in the cross-section drawing of FIG. 2. The stripper plate 12 is locked against the stripper plate seat 22 of the sleeve 16 by tightening the ring-shaped stripper plate retaining wire 18 in the space between the shoulder 24 inside the flange 11 of the stripper plate 12 and the inwardly extending lip 26 of the stripper cap 20 in a manner to be described hereafter.

Turning now to FIG. 2, it illustrates in a cross-section view, the assembly of the components illustrated in FIG. 1 into a punch set 10. The punch set 10 illustrated in FIG. 2 includes the centrally-disposed punch 50, including the punch blade 52 extending through the stripper plate opening 13, the punch holder 54, the bolts 56, 58, 60, the punch driver 62, and a punch-length adjustment mechanism 64 described more completely in the above-referenced co-pending application. The assembly of the punch 50 and the particular configuration and operation of its components are not critical to the present invention and thus are only briefly described. The punch assembly spring 64 surrounds the punch driver 62 and is held in place by first and second collars 66 and 68 that are bolted to the sleeve 16 and the driver 62. The collar 66, when assembled to the sleeve 16, also bears against the annular flange 70 of the punch driver 62 to maintain all the components in the assembled state depicted in FIG. 2.

As is well known in the art, in use, the sleeve 16 is inserted in a punch holder in the turret of a punch press, and the ram of the punch press strikes the punch driver to force the punch blade through a work piece in the opening of a matching die. The spring 64 is thus compressed during the punching operation and operates to withdraw the blade 52 from the die and workpiece upon retraction of the ram. In this process, the stripper plate 12 operates to strip away the punched-out blank or debris that may attach to the blade 52 in a process well known in the prior art.

Referring back to the first embodiment of the locking ring stripper plate assembly illustrated in FIGS. 1 and 2, the stripper plate 12 is attached to the seat 22 of the guide sleeve 16 inside flange 11 through the interaction of the retaining wire 18 with the shoulder 24 of the stripper plate 12 and the inwardly-extending lip 26 of the stripper cap 20. The stripper plate 12 has an outside diameter that fits within the inside diameter of the sleeve 16 and against the stripper plate seat 22. The height of the shoulder 24 matches the depth of the seat 22 so that the retaining wire 18 may be drawn against and over shoulder 24 when the ends 19 and 21 of the retaining wire 18 are drawn together by clockwise rotation of the stripper cap 20. Conversely, when the stripper cap 20 is rotated in the counter-clockwise direction, the ends 19 and 21 are drawn apart, and the retaining wire 18 retracts away from shoulder 24 and into the space beneath the inwardly-extending lip 26 so that the stripper plate 12 is released.

The end 19 of the retaining wire 18 extends into a hole 17 in the flange 11 of the sleeve 16 adjacent to the stripper plate seat 22. The other end 21 of the retaining wire 18 extends into a hole 25 in the inwardly-extending lip 26 of the stripper cap 20. Thus, relative rotation of the stripper cap 20 with respect to the stripper plate seat 22 draws the ends 19 and 21 toward or away from one another.

The rotation and retention of the stripper cap 20 with respect to the guide sleeve 16 is facilitated by the use of a flat spring wire 30 that is formed in a "wave" shape and fitted into annular grooves cut into the inner surface of the stripper cap 20 and the outer surface of the guide sleeve 16 as shown in greater detail in the remaining figures.

FIGS. 1 and 2 also show the locking mechanism for retaining the stripper cap 20 in the locked position. The locking mechanism 32 comprises the spring loaded button 34 and the coil spring 36 which biases the button 34 through the locking hole 27 in the stripper cap 20 in the locked position illustrated in FIG. 2.

Thus, when it is desired to unlock the assembly, the operator depresses the button 34 against the biasing spring 36 to release it from locking hole 27 and rotates the stripper cap 20 in the counter-clockwise direction to draw the end 21 extending through the hole 25 away from the end 19 extending into the hole 17. In so doing, the retaining wire 18 is drawn away from the shoulder 24 and inside the lip 26 until the stripper plate 12 falls free. Conversely, when the stripper plate is to be reattached, the operator places it against the seat 22 so that the opening 13 accommodates the punch blade 52 and twists the cap 20 in the clockwise direction until the button 34 snaps through the locking hole 27. In this assembly and process, only the stripper plate 12 is released while the stripper cap 20 and the other described components remain attached to the guide sleeve 16.

Figure 3B:
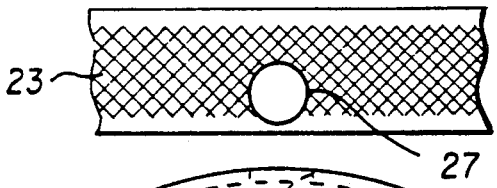
FIGS. 3A–3C are top plan, partial side and cross-section side views of the first preferred embodiment of a stripper cap employed in the assembly depicted in FIGS. 1 and 2.
Figure 3A:
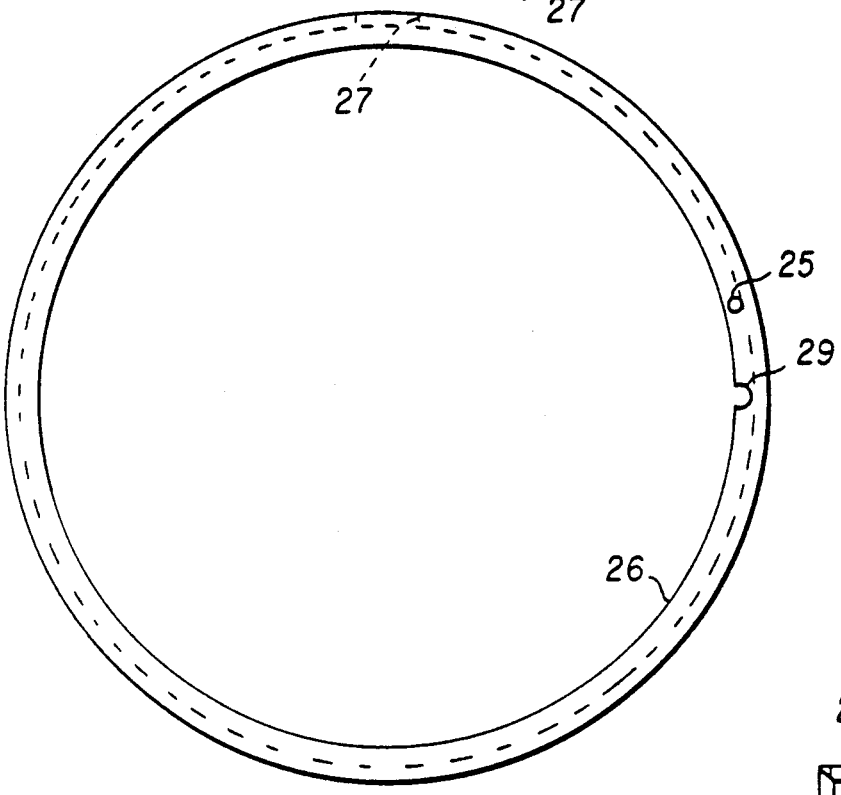
Figure 3C:
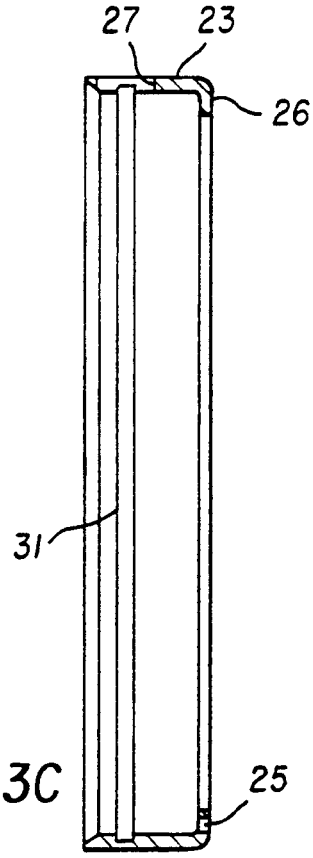

Turning now to FIGS. 3A–3C, they illustrate the shape and configuration of the stripper cap 20 in accordance with the first embodiment of the present invention. As described above, the stripper cap 20 is circular in shape and comprises a wall 23 formed with the inwardly-extending lip 26 and an annular groove 31 for receiving the wave wire 30. The locking hole 27 extends through the wall 23 and receives the spring loaded locking button 34 as described above. Similarly, FIG. 3C shows the hole 25 for receiving the end 21 of the retaining wire 18. A cutout 29 in the lip 26 is provided to allow the insertion of end 19 of wire 18 into the hole 17 with the stripper cap 20 assembled on the sleeve 16.

Figure 4A:
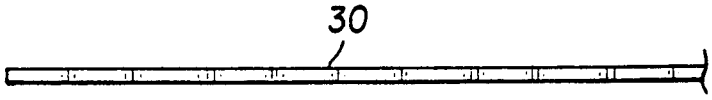
FIGS. 4A and 4B are plan and side views of a wave wire employed in the assembly of the stripper cap to the guide sleeve depicted in FIGS. 2 and 6.
Figure 4B:
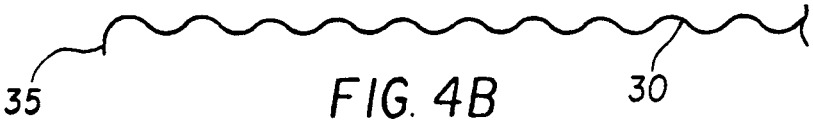

FIGS. 4A and 4B illustrate the shape of the wave wire 30 that fits within the annular grooves 31 and 33. One end 35 of the wave wire 30 is intended to fit into a hole 37 extending radially inwardly in the sleeve 16 (shown in FIG. 2) to prevent the wave wire from rotating with the rotation of the cap 20. The so-stabilized wave wire thus tends to act as a spring guide to prevent the cap 20 side wall 23 from binding against the sleeve 16 and to secure the cap 20 to the sleeve 16.

Figure 5A:
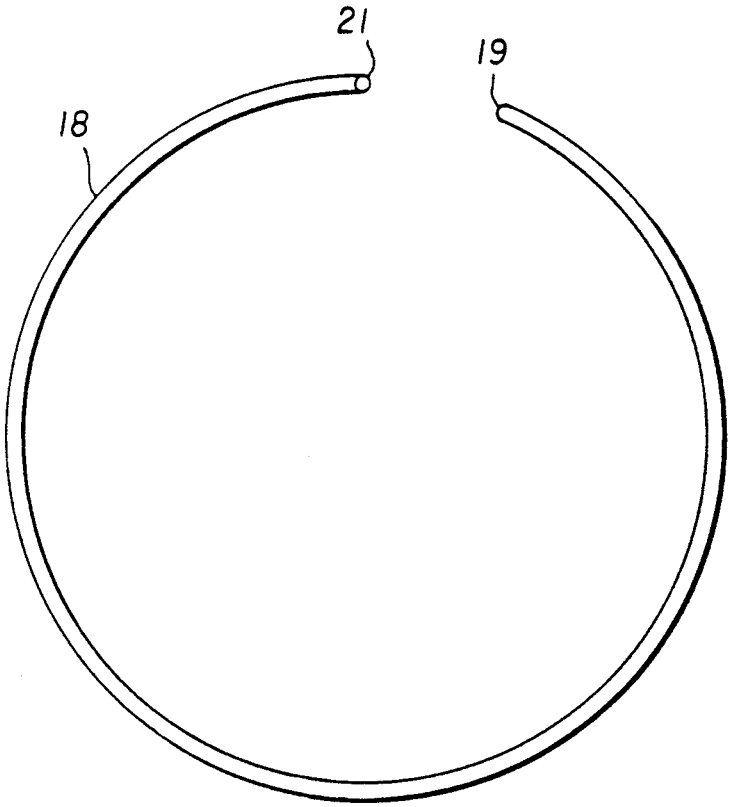
FIGS. 5A and 5B are plan and side views of a retaining wire employed in the first preferred embodiment of the present invention.
Figure 5B:
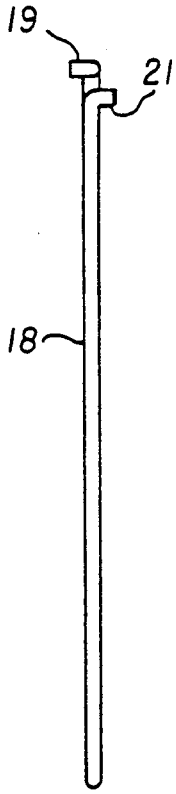

Turning now to FIGS. 5A and 5B, they illustrate in plan and side views the first embodiment retaining wire 18 and its ends 19 and 21. In this first embodiment, it may be seen that the retaining wire 18 generally extends in a circular shape through about 340° and is circular in cross-section.

Turning now to the description of the second illustrated embodiment of the invention, it constitutes a modification of the first illustrated embodiment in order to implement the concept of the present invention into a further type of punch set employed in a "thin turret" punch press. Punch sets and punch set holders formed in punch press turrets differ from manufacturer to manufacturer. Keyways and slots are formed in and extend along the punch sleeve interior or exterior surfaces to guide the reciprocating movements of the components of the punch set and the punch set with respect to the particular punch set holder during the punching operation. The keyways and guides thus stabilize and fit the punch set components together and/or to the punch set holder in the turret. In addition, sets of keyways allow the operator to select an orientation of a non-circular punch blade about its axis with respect to the punch guide to set it up to punch holes in workpieces at a desired angle, as is dconventional. Consequently, the embodiments of the present invention are realized in the context of these pre-existing limitations and restraints. Thus, while it would be desireable to employ a ring-shaped retaining wire to completely encircle the stripper plate, pre-existing punch set structure may limit the ability to do so. The second embodiment is thus presented as an implementation of the present invention in punch sets that fit a further type of "thin turret" punch press.

Figure 6:
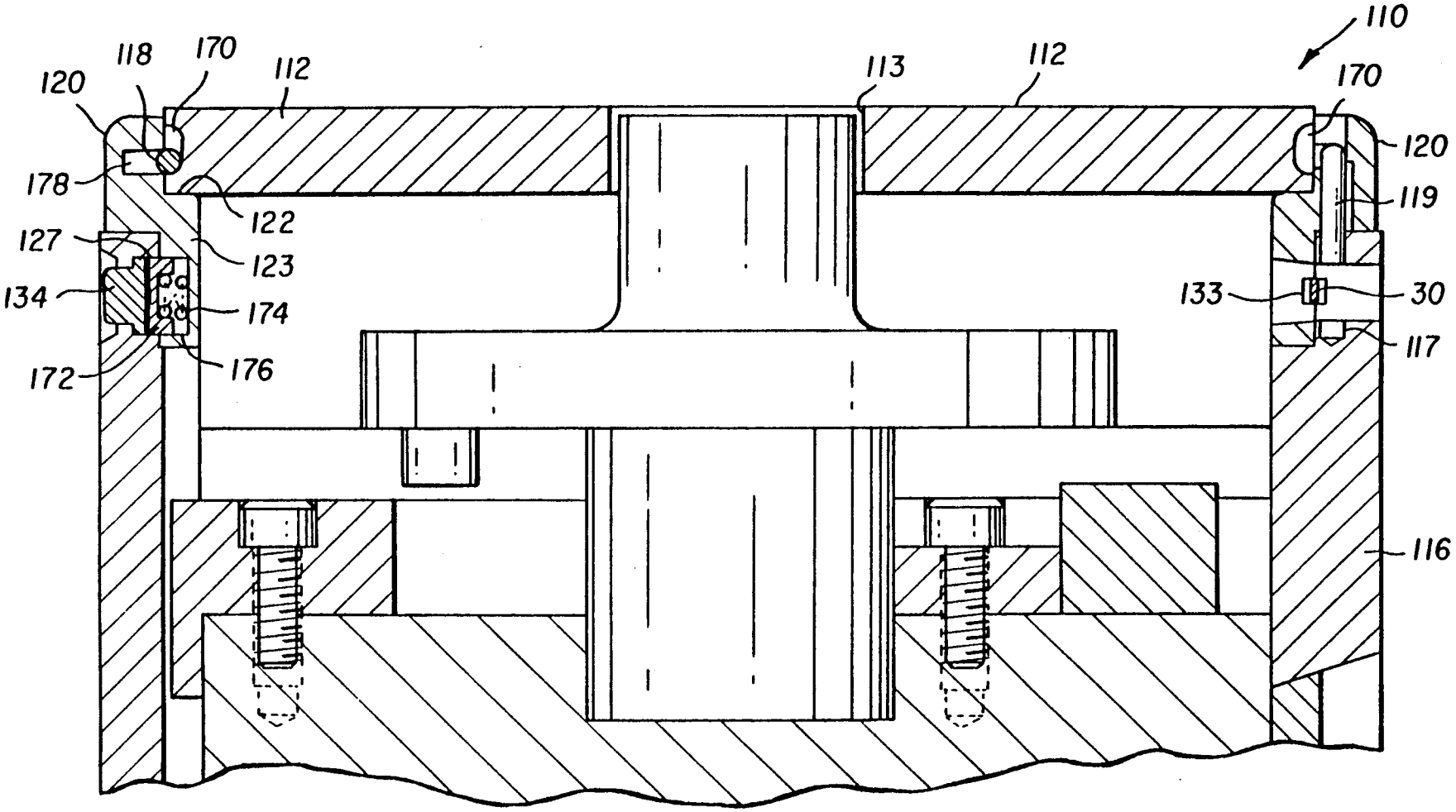
FIG. 6 is a cross-sectional view of a punch set assembly depicting the elements of the locking ring stripper plate assembly in accordance with the second preferred embodiment of the present invention.

In reference to FIG. 6, it illustrates a portion of a punch set 110, and in particular the assembly of the stripper plate 112 to the sleeve 116 through the interaction of the stripper cap 120, the retaining wire 118 and the locking mechanism 132. The stripper plate 112 is circular and has an annular groove 170 extending around its peripheral side wall for receiving the retaining wire 118 when the stripper cap 120 is in the locked position. The stripper plate 112 rests in the sleeve seat 122.

In this embodiment, the stripper cap 120 has a side wall 123 that extends within the open end of the sleeve 116, rather than extending over sleeve 116 as shown in the first embodiment of FIGS. 1-5. Consequently, the locking mechanism 132 includes a push button 134 that extends through and is trapped within the side wall of the sleeve 116 and contacts a spring-loaded catch 172 that bears against the coil spring 136 trapped within the bore 174 in the side wall 123 of the stripper cap 120. The locking mechanism 132 is operated by depressing the button 134 to compress the coil spring 174 and move the sliding catch 172 into the recess 176. Then the cap 120 may be rotated to move the ends 119 and 121 apart and expand the diameter of the retaining wire 118. The retaining wire 118 thus moves from the annular groove 170 in the edge of the stripper plate 112 into the annular groove 178 in the cap 120, whereupon the stripper plate 112 is released.

Reattachment of the stripper plate 112 is accomplished in the converse manner of positioning its edge against the stripper plate seat 122 and twisting the stripper cap 120 in the counter-clockwise direction to draw the ends 121 and 119 toward one another until the retaining wire 118 is drawn into the annular groove 170 and the sliding catch 172 snaps back into the locking hole 127 and into contact with the button 134.

Turning to FIGS. 7A and 7B, they illustrate the spring wire 118 in plan and side views. The spring wire 118 is formed as an arc of a circle of about 280° in view of particular restraints placed on the shape of the stripper cap 120 illustrated in FIGS. 8A-8C. In this particular case, keyways 102 and 104 must extend through the cap 120 where the retaining wire would pass, if the wire were extended around a greater circular arc.

Figure 8C:
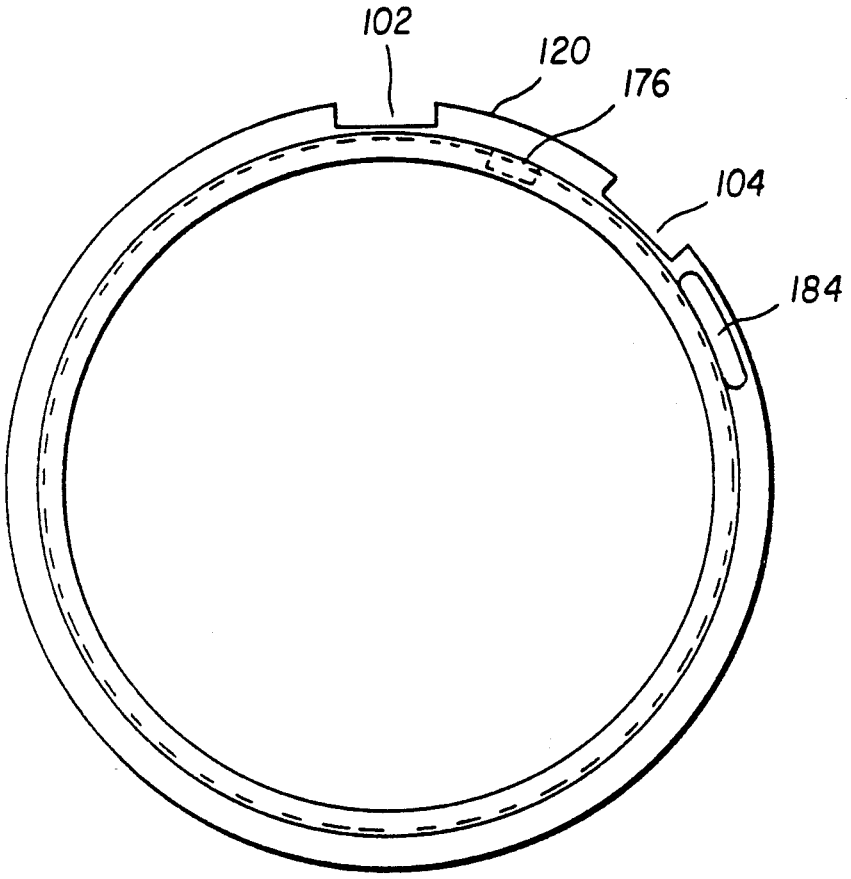

Turning to FIGS. 8A-8C, the illustrate in top, side cross-sectional and bottom views the configuration of the stripper cap 120 shown assembled in the cross-section view of FIG. 6.

FIG. 8B is a cross-section view taken along the lines III—III of FIG. 8A in order to illustrate the upward extending hole 125 for receiving the end 121 of retaining wire 118 and the downward extending bore 182 for receiving the other end 119 of retaining wire 118. The downward extending end 119 also fits in a bore 117 in sleeve 116 depicted in FIG. 6 and passes through the elongated slot 184.

FIG. 8B also shows the annular groove 131 cut in the exterior side wall 123 surface of the cap 120 which mates with an annular groove 133 cut in the exterior surface of the sleeve 116 to accept the wave wire 30 depicted in FIGS. 3A and 3B. In this embodiment, the end 35 of the wave wire 30 projects through the hole 180 to prevent it from slipping. The wave wire placed in the groove 131 and the matching annular groove 133 acts to both attach and slightly separate the mating surfaces of the stripper cap 120 and the guide sleeve 116 to inhibit binding that might otherwise occur when the stripper cap is twisted back and forth on the guide sleeve surface.

It will be understood that while it is desirable that the retaining force be distributed as equally as possible against the shoulder 24 through 360°, this may be accomplished by splitting the retaining wire 18 into two or more arcuate shaped sections each attached at the free ends thereof to the sleeve 16 and the cap 20 in the manner as described above. For example, the retaining wire 18 may be split into two arcs, and each wire may be attached at its ends to a further hole in the cap and in the sleeve end appropriately positioned about 180° apart from the locations depicted.

Figure 9:
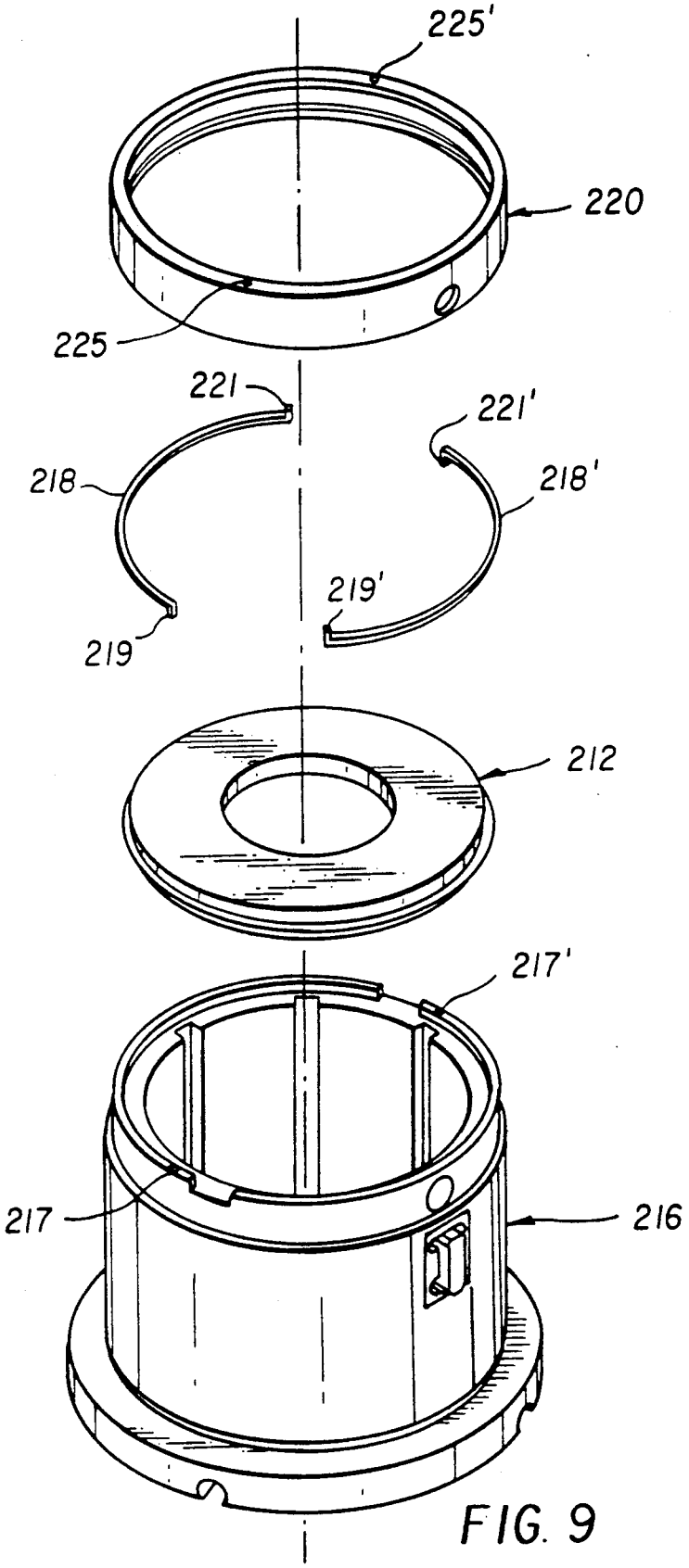
FIG. 9 is an exploded, perspective view of a further preferred embodiment of the locking ring stripper plate assembly of the present invention.

Such an embodiment is depicted in the exploded perspective view of FIG. 9. In this embodiment, the first and second retaining wires 218 and 218' are formed of square cross-section wires having ends 219, 219' and 221, 221' that fit into the holes 217, 217' and 225, 225', respectively. The wires 218, 218' are tightened around the stripper plate 212 by clockwise rotation of the cap 220 with respect to the sleeve 216 and loosened by counter-clockwise rotation of these components.

Many changes to the disclosed preferred embodiments will thus be readily apparent to those skilled in the art when the concepts of the present invention are implemented in punch sets that are otherwise configured to fit the requirements of the punch presses and turrets of various manufacturers. Punch sets are constructed in a wide variety of shapes and sizes with removable and interchangeable components that require the replacement of stripper plates or removal of the stripper plates to gain access to other components of the punch set. As can be seen by contrast to the extensive prior art, the present invention offers a simple, inexpensive and reliable solution to the problems inherent in the removal and reattachment of stripper plates to punch sets.

Therefore, while we have described the best modes known at the present time for carrying out the invention, it will be understood that various changes, adaptations and modifications may be made therein without departing from the spirit of the invention and the scope of the appended claims.

We claim:

1. A punch guide sleeve and stripper plate assembly useable with a punch set of the type having a punch disposed within the punch guide sleeve and reciprocally advanced through an opening of a stripper plate attached to one end of the punch guide sleeve by a ram of a punch press, wherein said stripper plate further includes an annular edge portion, and stripper plate locking means for locking said annular edge portion of said stripper plate to a seat in a locked position and releasing said stripper plate from said seat in an unlocked position, said locking means further comprising:

stripper cap means having a first annular surface for engaging with said punch guide sleeve for moving between said locked and unlocked positions; retaining means having first and second ends and formed in an arcuate shape for engaging with said annular edge portion of said stripper plate in said locked position of said stripper cap means and for withdrawing from said annular edge portion of said stripper plate in said unlocked position, and means for attaching said first end of said retaining means to said stripper cap means and said second end of said retaining means to said guide sleeve, whereby movement of said cap means draws said first and second ends toward one another in the locked position and away from one another in the unlocked position.

2. The assembly of claim 1 further comprising:

locking means for releasably locking said stripper cap means in said locked position to maintain said retaining means in contact with the annular edge portion of said stripper plate.

3. The assembly of claim 1 wherein said stripper cap means further comprises:

a second annular surface defining said seat and means for receiving said retaining means in said unlocked position.

4. The assembly of claim 3 wherein said annular edge portion of said stripper plate comprises a groove extending around a side edge of said stripper plate for receiving said retaining means in said locked position.

5. The assembly of claim 4 further comprising:

locking means for releasably locking said stripper cap means is said locked position to maintain said retaining means in said groove of said stripper plate.

6. The assembly of claim 4 wherein said stripper cap means further comprises an annular slot extending around said stripper cap means adjacent to said groove in said stripper plate positioned in said seat for receiving said retaining means in said unlocked position.

7. The assembly of claim 1 wherein said seat is formed in an end of said sleeve and said stripper cap means is formed with a second inwardly directed annular surface for receiving said retaining means between said second inwardly directed annular surface and the end of said sleeve in said unlocked position.

8. The assembly of claim 7 wherein said annular edge portion of said stripper plate comprises annular shoulder means for receiving said retaining means in said locked position.

9. The assembly of claim 8 further comprising:

locking means for releasably locking said stripper cap means in said locked position to maintain said retaining means in contact with the annular shoulder portion of said stripper plate.

10. The assembly of claim 7 wherein:

said second inwardly directed annular surface of said stripper cap means is formed with means for receiving said first end of said retaining means; and said end of said sleeve is formed with means for receiving said second end of said retaining means.

11. A stripper plate locking assembly for removeably attaching a stripper plate to a punch guide sleeve having an open stripper plate receiving end with a stripper plate seat formed thereon comprising:

said stripper plate shaped to fit the seat of the punch guide sleeve and having a peripheral shoulder formed annularly around an outer edge thereof;

an annular stripper plate cap having a side wall and an inwardly extending lip, wherein said side wall is configured to fit around and engage with an exterior of the punch guide sleeve stripper plate receiving end with the lip extending inwardly a distance over the end of the guide sleeve;

means for mounting said stripper plate cap onto said punch guide sleeve for allowing relative rotation thereof between a locked and an unlocked position;

retaining means having a first end and a second end for engaging with said shoulder of said stripper plate and for retaining said stripper plate against said stripper plate seat in the locked position of said stripper cap and for retracting from engagement with said shoulder of said stripper plate in the unlocked position of said stripper cap; and means for attaching the first end of said retaining means to said stripper cap and said second end of said retaining means to said punch guide sleeve.

12. The assembly of claim 11 further comprising:

means for releasably locking said stripper plate cap in said locked position to lock said stripper plate against said stripper plate seat by drawing said stripper plate retaining means onto said stripper plate shoulder.

13. The assembly of claim 11 further comprising:

locking means having manually releasable catch means extending between said guide sleeve and said stripper plate cap for preventing rotation of said stripper plate cap from said locked position in order to maintain said retaining means in contact with the annular shoulder of said stripper plate during use.

14. The assembly of claim 13 wherein:

said lip of said stripper plate cap is formed with first means for receiving said first end of said retaining means; and said end of said sleeve is formed with second means for receiving said second end of said retaining means.

15. The assembly of claim 14 wherein said retaining means is an arcuate length of wire having said first end formed to be received by said first receiving means and said second end formed to be received by said second receiving means, whereby rotation of said stripper plate cap with respect to said punch guide sleeve in one direction draws said first and second ends toward one another and the arcuate length of wire onto said shoulder of said stripper plate in said locked position and rotation in the opposite direction draws the first and second ends apart and the arcuate length of wire away from said shoulder in said unlocked position.

16. The assembly of claim 11 wherein:

said lip of said stripper plate cap is formed with first means for receiving said first end of said retaining means; and said end of said sleeve is formed with second means for receiving said second end of said retaining means.

17. The assembly of claim 16 wherein said retaining means is an arcuate length of wire having said first end formed to be received by said first receiving means and said second end formed to be received by said second receiving means, whereby rotation of said stripper plate cap with respect to said punch guide sleeve in one direction draws said first and second ends toward one another and the arcuate length of wire onto said shoulder of said stripper plate in said locked position and rotation in the opposite direction draws the first and second ends apart and the arcuate length of wire away from said shoulder in said unlocked position.

18. A stripper plate locking assembly for removeably attaching a stripper plate to a punch guide sleeve having an open stripper plate receiving end comprising:

an annular stripper plate cap having a side wall for rotatively engaging with a periphery of said stripper plate receiving end of said guide sleeve for rotating between a locked and an unlocked position and having an annular shoulder seat for receiving a peripheral surface of said stripper plate;

retaining means having first and second ends for engaging with said stripper plate in said locked position of said stripper plate cap and for retracting into said stripper plate cap in said unlocked position;

means for coupling said first end of said retaining means to said stripper cap; and means for coupling said second end of said retaining means to said sleeve, whereby rotation of said stripper cap on said sleeve between said locked and unlocked positions respectively draws said first and second ends of said retaining means toward and away from one another and said retaining means into and away from engagement with said stripper plate.

19. The assembly of claim 18 wherein said peripheral surface of said stripper plate comprises an annular groove for receiving said retaining means in said locked position.

20. The assembly of claim 19 further comprising:

means for releasably locking said stripper plate cap in said locked position to lock said stripper plate against said stripper plate seat by drawing said stripper plate retaining means into said annular groove.

21. The assembly of claim 19 further comprising:

manually releasable catch means extending between said guide sleeve and said stripper plate cap for preventing rotation of said stripper plate cap from said locked position in order to maintain said retaining means in contact with said stripper plate during use.

22. The assembly of claim 19 wherein said stripper cap further comprises an annular slot extending around said stripper cap adjacent to said groove in said stripper plate positioned in said seat for receiving said retaining means in said unlocked position.

23. The assembly of claim 22 wherein:

said annular slot of said stripper plate cap is formed with first means for receiving said first end of said retaining means; and said end of said sleeve and said seat of said stripper plate cap are formed with second means for receiving said second end of said retaining means.

24. The assembly of claim 23 wherein said retaining means is an arcuate length of wire having said first end formed to be received by said first receiving means and said second end formed to be received by said second receiving means, whereby rotation of said stripper plate cap with respect to said punch guide sleeve in one direction draws said first and second ends toward one another and the arcuate length of wire into said annular groove of said stripper plate in said locked position and rotation in the opposite direction draws the first and second ends apart and the arcuate length of wire into said annular slot of said stripper plate cap in said unlocked position.

* * * * *